US012310487B2

(12) United States Patent
Alley

(10) Patent No.: US 12,310,487 B2
(45) Date of Patent: May 27, 2025

(54) LOAD DISTRIBUTION SYSTEMS AND LOAD CARRYING EQUIPMENT

(71) Applicant: Randall Alley, Thousand Oaks, CA (US)

(72) Inventor: Randall Alley, Thousand Oaks, CA (US)

( * ) Notice: Subject to any disclaimer, the term of this patent is extended or adjusted under 35 U.S.C. 154(b) by 169 days.

(21) Appl. No.: 18/169,048

(22) Filed: Feb. 14, 2023

(65) Prior Publication Data

US 2023/0200521 A1 Jun. 29, 2023

Related U.S. Application Data

(63) Continuation of application No. 17/492,431, filed on Oct. 1, 2021, now Pat. No. 11,596,219, which is a continuation of application No. 16/348,647, filed as application No. PCT/US2017/060967 on Nov. 9, 2017, now Pat. No. 11,140,969.

(60) Provisional application No. 62/419,653, filed on Nov. 9, 2016.

(51) Int. Cl.
*A45F 5/00* (2006.01)

(52) U.S. Cl.
CPC ..... *A45F 5/00* (2013.01); *A45F 2005/008* (2013.01)

(58) Field of Classification Search
CPC ..... A45F 2005/008; A45F 3/10; A45F 2003/006; A61F 5/01; A61F 5/3723; A61F 5/0102; A61F 5/0118; B25J 9/0006; Y10S 901/49
See application file for complete search history.

(56) References Cited

U.S. PATENT DOCUMENTS

| | | | | |
|---|---|---|---|---|
| 6,997,891 | B1 * | 2/2006 | Vecsey | A61F 5/0195 602/10 |
| 8,955,726 | B1 * | 2/2015 | Thielman | F41B 13/04 224/267 |
| 9,931,701 | B1 * | 4/2018 | Klein | B25F 5/026 |
| 10,610,438 | B1 * | 4/2020 | Dines | B25J 9/0006 |
| 11,696,633 | B1 * | 7/2023 | Parazynski | F16M 13/04 24/3.2 |
| 2010/0106065 | A1 * | 4/2010 | Ward | A61F 5/0104 602/23 |
| 2013/0110022 | A1 * | 5/2013 | Meals | A61F 5/0118 602/20 |
| 2015/0173992 | A1 * | 6/2015 | Wang | A61H 1/0277 601/5 |
| 2018/0055591 | A1 * | 3/2018 | Bonny | A61B 90/57 |
| 2019/0151184 | A1 * | 5/2019 | Murakami | A61H 3/008 |
| 2020/0054117 | A1 * | 2/2020 | Alley | F41C 33/00 |

(Continued)

*Primary Examiner* — Brian D Nash
(74) *Attorney, Agent, or Firm* — Joseph A. Andelin; Fish IP Law, LLP

(57) ABSTRACT

A load carrying and force distributing interface to be worn on a user's limb is described. The interface has one or more support members sized and dimensioned to fit around the user's limb, at least three elongated compression members circumferentially spaced apart and around the limb, and a sensor, an actuator, and a controller configured to dynamically adjust a compression level of at least one of the elongated compression members. The controller could also be configured to adjust one or more elongated compression members so as to compress the soft tissue of the limb against the bone structure to thereby reduce relative motion between the bone structure and the interface.

23 Claims, 14 Drawing Sheets

(56) References Cited

U.S. PATENT DOCUMENTS

| | | | | |
|---|---|---|---|---|
| 2020/0056741 | A1* | 2/2020 | MacArthur | F16M 11/2064 |
| 2020/0163787 | A1* | 5/2020 | Goldfarb | B25J 9/0006 |
| 2022/0096309 | A1* | 3/2022 | Realmuto | A61H 1/0285 |
| 2022/0370224 | A1* | 11/2022 | Seifert | A61F 2/748 |
| 2023/0329892 | A1* | 10/2023 | Karasahin | G16H 20/30 |
| 2024/0148522 | A1* | 5/2024 | Farris | A61F 2/70 |

* cited by examiner

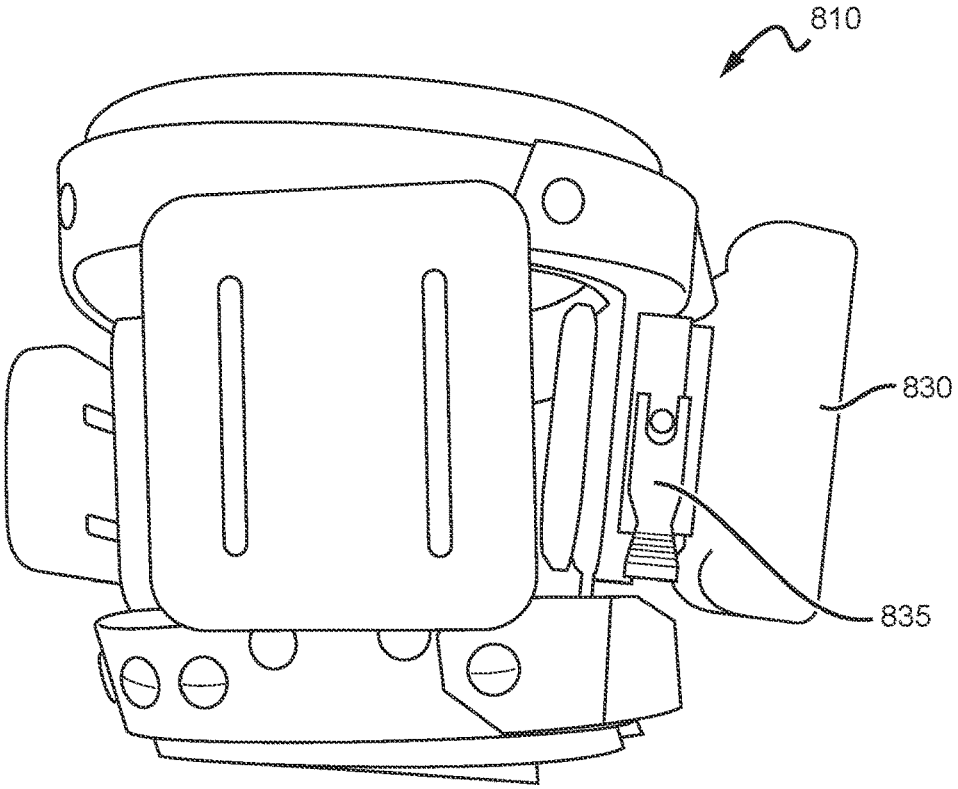
FIG. 8d
FIG. 8e
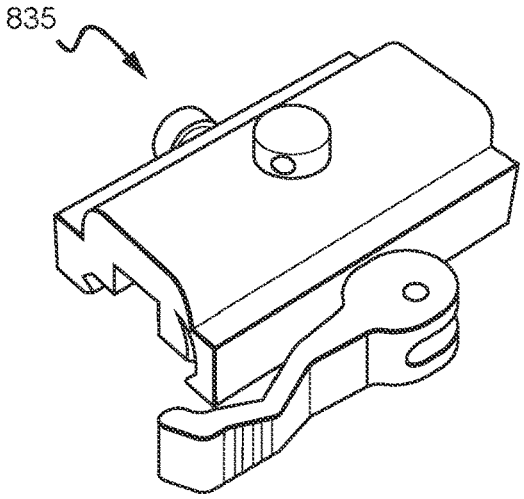
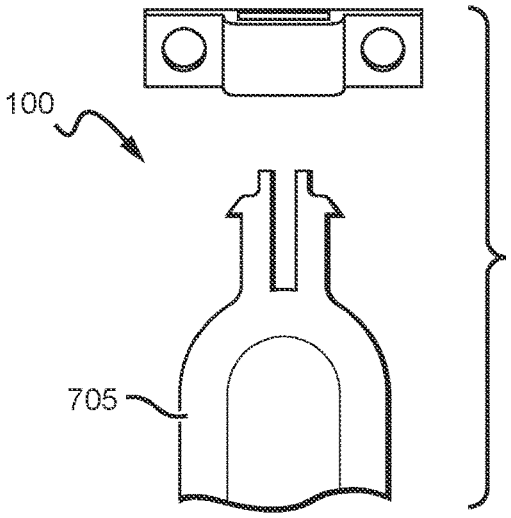
FIG. 9

FIG. 21
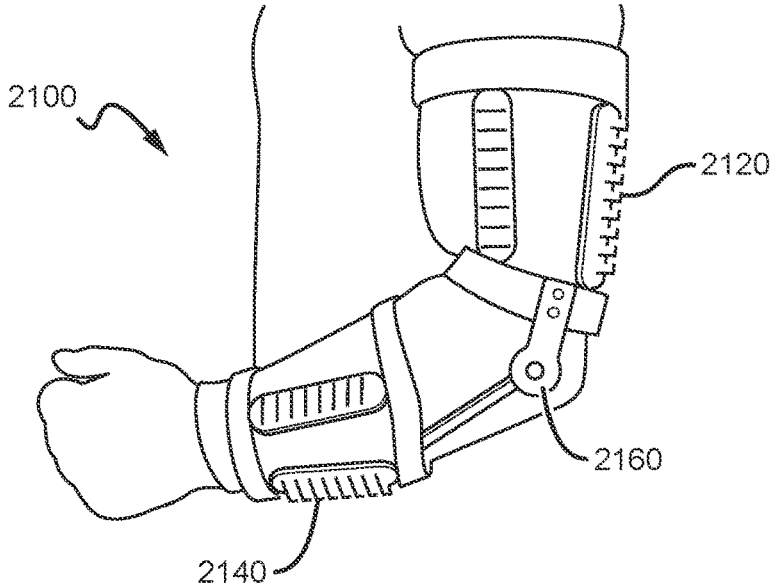
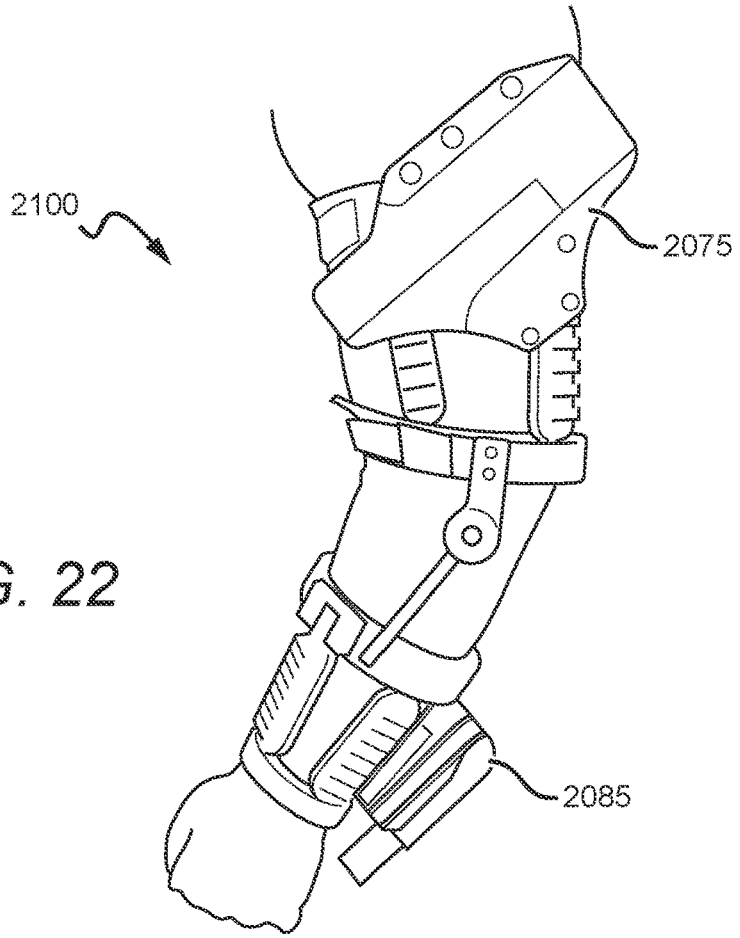
FIG. 22

FIG. 23
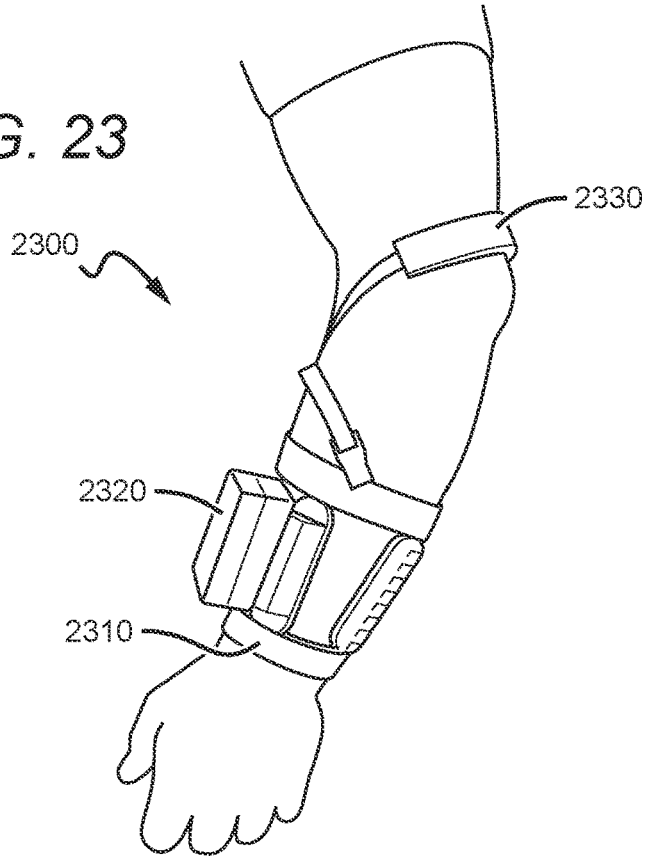
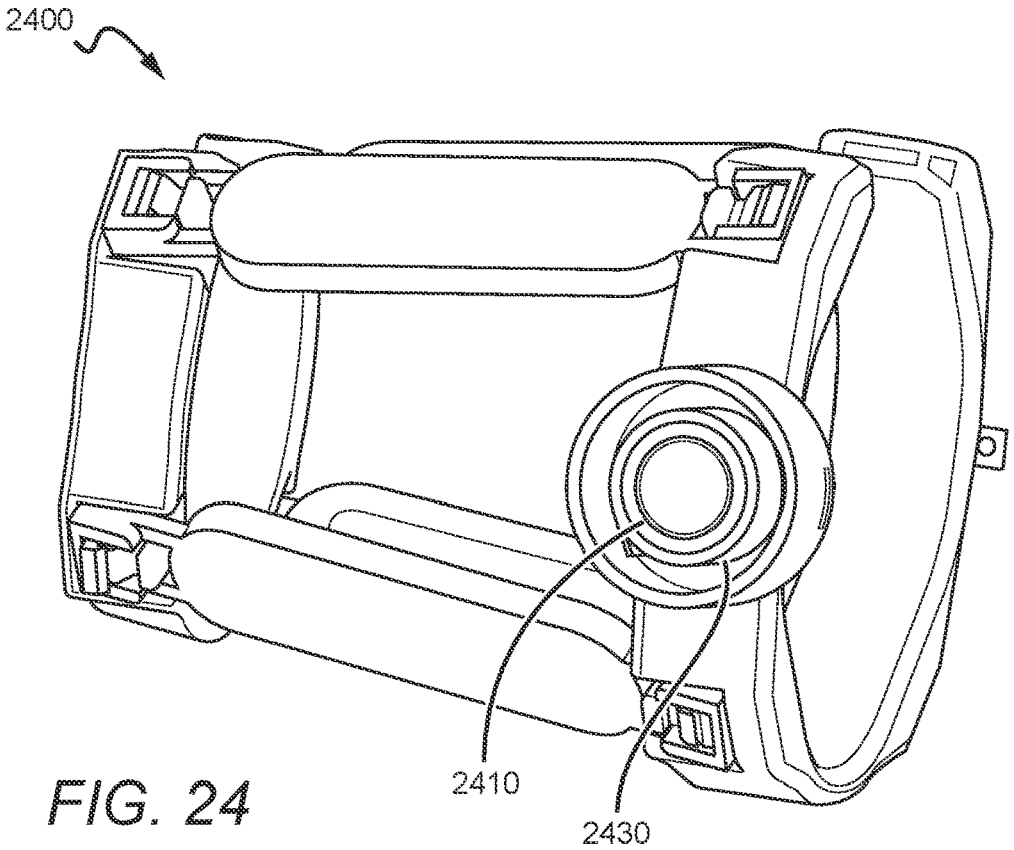
FIG. 24

LOAD DISTRIBUTION SYSTEMS AND LOAD CARRYING EQUIPMENT

This application is a continuation of and claims priority to U.S. application Ser. No. 17/492,431, filed on Oct. 1, 2021, which is a continuation of and claims priority to U.S. application Ser. No. 16/348,647, filed on May 9, 2019, which is a national stage entry of and claims priority to PCT/US2017/060967, filed on Nov. 9, 2017, which is based on and claims priority to U.S. Provisional Application Ser. No. 62/419,653, filed Nov. 9, 2016. All extrinsic materials identified herein are incorporated by reference in their entirety.

FIELD OF THE INVENTION

The field of the invention is load distribution systems (LDS) and load carrying equipment (LCE), and more particularly, biomechanical interfaces.

BACKGROUND

The background description includes information that may be useful in understanding the present invention. It is not an admission that any of the information provided herein is prior art or relevant to the presently claimed invention, or that any publication specifically or implicitly referenced is prior art.

The backpack has become a preferred way to transport larger items and possessions. Heavy load backpacks can comfortably carry even more items than a regular backpack, due to the added support of an internal or external frame and better padding. For example, heavy load backpacks are frequently used by military organizations around the world to move heavy equipment across long distances and over difficult terrain that is not accessible to vehicles. The equipment could include weapon diagnostic and communication equipment for a soldier, and/or heavy tools and tool kits. Heavy load backpacks are also frequently used by emergency response teams to transport food, shelter materials, and clothing to areas struck and damaged by natural disaster. In addition, heavy load backpacks are frequently used by hikers and mountain climbers in the wilderness, for carrying medicinal kits, survival tools, books, and electronic devices.

Load Carrying Equipment (LCE), such as the heavy load backpack, is an especially important component in the arsenal of the modern soldier, who must frequently transport gear and heavy payloads. Ideally, the LCE should provide both freedom of movement and immediate accessibility to vital equipment carried by the wearer without sacrificing agility of motion or speed of deployment. To date, nearly all LCEs comprise a portable backpack which includes a frame, pockets that may be detachable, adjustable shoulder supports and waist belts. The frames may be external or internal to the main backpack and are generally constructed to provide structure for load distribution. Considerable effort has gone in recent years into improving and enhancing the battlefield backpacks, concentrating for example on making the frames lighter, less rigid and more flexible so as to increase mobility and lower fatigue.

U.S. Pat. No. 5,806,740, for example, teaches a flexible frame having a modular construction including storage modules mounted on a flexible pack frame such that they can be released without removing the entire pack frame using suitable devices affixed to the frame. The pack frame disclosed in this, and other similar patents is also provided with an integrated adjustment mechanism for selectively increasing or decreasing the length of the shoulder support straps and rib-cage straps of the backpack, as well as the distance between the waist belt and pack frame so as to adapt to the wearer's torso and waist without having to remove the backpack from the wearer's back.

There are many other heavy load backpacks that are especially designed to improve ergonomics and comfort. U.S. Pat. No. 7,931,178, for example, discloses a backpack that suspends the load from a frame so it can move up and down relative to the wearer's body as the wearer walks or runs, to thereby reduce the forces on the wearer's body. U.S. Pat. No. 7,967,175 teaches a backpack that has a suspension system. U.S. Pat. No. 8,172,117 teaches a backpack that has stability enhancing features. U.S. Pat. No. 8,783,537 teaches a backpack that has some unique features for ergonomics and comfort. In addition, other publications teach backpacks that are designed to provide better protection to electronics and wiring harnesses that are stowed in backpack.

Unfortunately, conventional backpacks have some limitations. For example, as discussed in U.S. Pat. No. 7,931,178, peak forces exerted on the body can increase dramatically when the user is moving compared to stationary. This increase is due to the constant acceleration and deceleration of the load, as the load tracks the vertical movement of the hips on every step. These high and jarring peak forces make it difficult to move or change direction at high speeds, especially with larger loads. The peak forces also contribute to the muscular and orthopedic injury, and increases the user's metabolic rate.

Load Distribution Systems (LDS) are designed to address the limitations of backpacks and other LCE, by controlling peak forces using various approaches. For example, one approach is to provide suspension and shock absorption between the load and the user to damper movement without limiting mobility. Another approach is to convert the physical movement into electrical or mechanical energy using a motor-based system, thereby resulting in a suspended-load relative to the wearer that reduces the forces on the wearer's body while moving. While beneficial in some respects, these approaches add further complexity and weight to a backpack already saddled with numerous compartments and heavy gear, and often compromises other features such as gear accessibility. In addition, the suspension systems are not readily compatible with quick disconnect systems or storage compartments, and the straps and belts that need to be adjusted rapidly and under duress. Furthermore, these systems do not remedy the hardships of accessing portions of the backpack to retrieve an item. For example, a user may need to rotate the backpack in order to visually see the item that is desired, or a user may need to rotate their body in order to reach for the compartment of the backpack desired. Such hardships are examples of obstacles that are undesired when carrying a load.

Furthermore, even as such ergonomically improved backpacks enter the commercial market and are introduced to warfighters, the equipment to be carried and utilized keeps increasing in both weight and complexity of handling.

Therefore, there remains a need for a new load distribution system that (1) reduces strain on the body when carrying a load, (2) improves and enhances accessibility of various payload components, (3) greatly reduces the risk of injury, by improving overall distribution of load position, orientation and placement in relation to the individual's core and (4) allows for easier maneuvering and overall agility while carrying heavier loads.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is still a need in the art for improved load distribution systems and methods.

SUMMARY OF THE INVENTION

The inventive subject matter provides apparatus, systems, and methods in which an improved load distribution system has one or more load carrying devices (e.g., interfaces) that can be worn on a user's limb to distribute and carry the load. The load carrying devices are designed to interface with the limb in a manner that optimizes load distribution and load stability. This is achieved through alternating compression areas and relief areas (or zones) that compress the soft tissue of the limb and reduce motion of the interface relative to the bone structure. As used herein, the term "lost motion" refers to the motion of the underlying skeletal structures of a user's limb with respect to the load carrying device when force is applied between the two as would occur as the user tries to move the load carrying device as a whole. In some conventional load carrying devices, lost motion occurs when the underlying skeletal structure of a user moves toward an internal wall of the load carrying device a substantial distance before imparting force on the wall. The result is that a user can more safely and comfortably carry a heavier load across longer distances and/or more difficult terrain.

The disclosed methods and apparatus systems are especially intended to alleviate problems associated with load carrying equipment (LCE), such as backpacks, by distributing some of the load to the person's extremities. The inventive subject matter provides greater economy of motion, higher mobility, lower dynamic forces during gait, greater accessibility to equipment needed without interrupting motion, and potentially greater endurance even at faster speeds. The invention can therefore contribute to a wide range of health and societal benefits for those tasked with carrying very heavy loads such as soldiers, first responders, disaster relief workers, fire fighters, explorers and field scientists, divers and astronauts as well as for recreational uses such as long range hiking and mountain climbing.

In some cases, such as that of a warfighter, the ability to access gear can mean the difference between life and death. In other cases, the ability to carry life-saving equipment to a disaster/emergency site faster could be the difference between mission success and failure. Furthermore, the inventive subject matter disclosed herein can greatly contribute to lower incidence of orthopedic and muscle injury during battlefield or strenuous athletic activities while permitting maximum mobility and joint flexibility. Finally, a modified aspect of the invention results in a new and novel fracture bracing system that permits an injured soldier or wilderness hiker to self-extract from the scene far enough to receive needed help.

It should be appreciated that the inventive subject matter can provide a new type of Load Distributing System (LDS) that can be worn on the extremities and affixed with a variety of components and equipment needed to execute various tasks while retaining optimum mobility and agility even under highly challenging terrain conditions.

The inventive subject matter can further allow utilization of the LDS either on its own or in conjunction with other equipment stored in backpacks, including the ergonomic versions developed in the prior art. In either case, the LDS serves the purpose of redistributing weight and at the same time, allows greater and/or faster accessibility to needed equipment. In the case of the warfighter, the LDS will ensure more efficient and comfortable wearable weapon and armor/diagnostic systems while potentially reducing injuries. In the case of the average consumer, the LDS provides quick accessibility to everyday items, such as a phone, wallet, water bottle, tools, devices, etc.

Furthermore, the inventive subject matter can provide interfaces for load distribution systems that are mounted on upper and/or lower extremities such that they provide sufficient stability to the underlying long bone, thereby facilitating mounting of equipment essential to the wearer's activities. As used herein, the term "interface" is used as a synonym for load carrying device. The LDS may be custom adjusted to the individual's anatomy a priori, including attachment mechanisms that allow the load to be releasably connected such that it can be rapidly removed or remounted.

Yet another contemplated benefit of the inventive subject matter is to provide an LDS that is designed to increase soldier agility and reduce physical fatigue of the soldier from the weight of the load being carried and to enhance the effectiveness of the soldier's performance.

The interfaces can be further coupled with a robotic system, such as an exoskeleton suit, as a way of augmenting human strength, endurance, and mobility for the warfighter of the future. Moreover, the interfaces can augment the performance, stability, and weight distribution of an exoskeleton suit.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 8*d* is a side view of the load carrying device of FIG. 8*b* with a load attached thereto.

FIG. 8*e* is a perspective view of the quick release lever fastener used to attach the load in FIG. 8*d*.

FIG. 9 is a plan view of a quick release fastener for an elongated compression member.

FIG. 21 is a side view of another embodiment of a load distribution system in a bent configuration.

FIG. 22 is a side view of the load distribution system of FIG. 21 in a straight configuration.

FIG. 23 is a side view of a user wearing a load carrying device in combination with an elbow strap.

FIG. 24 is a side view of a load carry device that has a torsion spring for providing tension to a strap.

DETAILED DESCRIPTION

Figure 1:
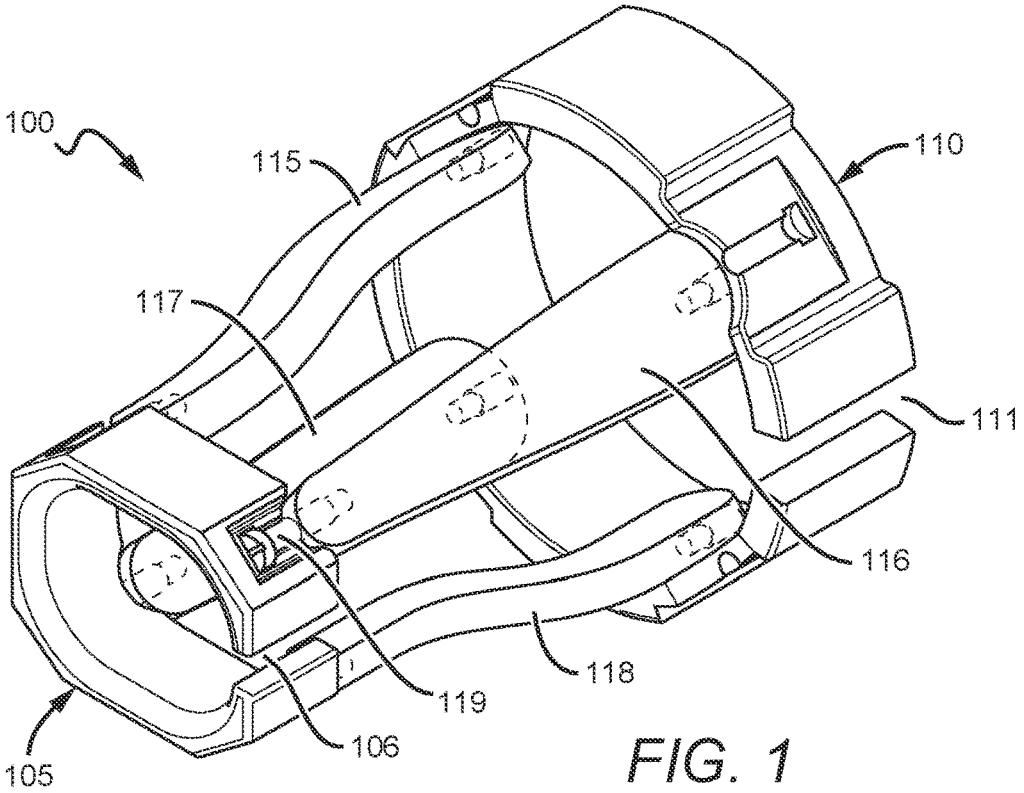
FIG. 1 is a perspective view of one embodiment of a load carrying device.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

The load distribution systems (LDS) described herein derives from concepts and approaches originally developed for prosthetic interfaces, collectively known as the High Fidelity (or HiFi™) interface, as disclosed for example in U.S. Pat. Nos. 8,323,353, 8,656,918, and 9,283,093, which are incorporated by references herein. The HiFi™ Interface was initially designed to address the challenges faced by prosthetic wearers, including poorly fitting and performing sockets, especially when using more advanced and heavier dexterous arms and powered prosthetic limbs. Thus, traditional prosthetic sockets are bucket-like structures that even in their most advanced versions still allow the underlying bone of the encapsulated limb to significantly move within the socket, resulting in a very long list of troublesome issues including loss of energy and stability when walking, standing or running, lifting or reaching, pain, significantly reduced range of motion, reduced proprioception and accelerated osteoarthritis and other joint degradation.

By contrast, the HiFi™ interface concept represents a paradigm-changing interface approach that captures the bone through a series of interleaving compression and relief zones, based upon the concept of Osseostabilization™. Through numerous studies it was demonstrated that by capturing and holding the underlying bone in place, the user's comfort and control substantially increase. The technique represents a radical departure from approaches that focus on global, generic surface tension, using instead a series of alternating compression and tissue release zones to gently displace a volume of soft tissue out of the field of compression. By getting closer to the target long bone, unwanted motion of the shaft of the bone are greatly reduced, which leads to a much more efficient transfer of energy directly to the prosthesis itself.

The HiFi™ interface system has been found to be far more efficient and stable, and makes the prosthesis feel more like a part of the wearer's body, as evidenced by numerous patient reports and independent clinical investigations. With the bone "captured", the wearer feels "more connected" to the prosthesis and many report they forget they are wearing their prosthesis at all. Significantly, the HiFi™ approach preserves much of the energy that is wasted in a traditional socket, making the prosthesis feel lighter and less fatigue-inducing. HiFi™ patients also report increased proprioception and "feelings" in their lost limb, a greater level of confidence, improved range of motion, ability to wear their prostheses all day, and there are also indications that that HiFi™ is enhancing blood flow through improved deep venous return. The prosthetic success of HiFi™ technology has been clinically proven, as HiFi™ products are currently being worn by thousands of amputees. HiFi™ technology was also selected by Defense Advanced Research Projects Agency (DARPA) as the interface platform for the DEKA Luke Arm and for additional product development work with biodesigns.

The present inventive subject matter derives from the belief that a HiFi' like approach can also provide an ideal connection for where man meets machine in many situations requiring individuals to carry heavy loads over uneven terrains, including warfighter applications. Specifically, the inventor believes that applying the HiFi' concept to the able individual could provide a radically new way to attach external implements to a human operator as a way of offloading centrally carried mass traditionally worn in a backpack to the extremities while preserving full range of motion and energy. Such systems are collectively referred to as LDS, for Load Distributing Systems.

FIG. 1 shows a load carrying device 100. Device 100 comprises a distal support member 105 and a proximal support member 110 connected with four elongated compression members 115, 116, 117, and 118.

Figure 2:
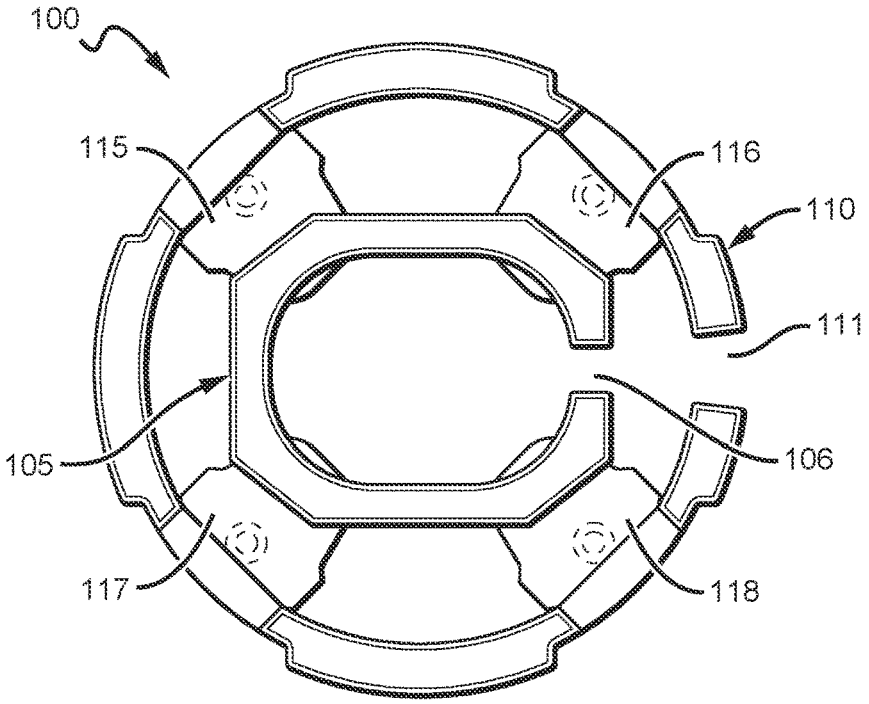
FIG. 2 is a front view of the load carrying device of FIG. 1.

As best seen from the front view of FIG. 2, proximal support member 110 has a larger inner diameter than distal support member 105, although this can vary depending on the shape of the arm. Distal support member 105 is sized and dimensioned to fit around, and be worn on, a distal portion of the user's limb. It is contemplated that the user's limb is the upper limb of a user, such as an arm. However, in other embodiments, it is contemplated that the user's limb is the lower limb of a user, such as a leg. Likewise, proximal support member 110 is sized and dimensioned to fit around, and be worn on, a proximal portion of the user's limb (relative to the distal support member 105).

Support members 105 and 110 are also referred to herein as cuffs, rings, and/or brackets. Support members 105 and 110 have a general ring shape with openings 106 and 111, respectively. Alternatively, it is contemplated that support members 105 and 110 could be a continuous ring (e.g., a closed loop). Openings 106 and 111 allow the user to slide a limb into support members 105 and 110, and also allow the user to adjust (e.g., loosen or tighten) the inner diameter of support members 105 and 110 around the limb. For example, support members 105 and 110 can be made of a material that has sufficient elasticity to allow support members 105 and 110 to tighten around the limb such that elongated compression members 115, 116, 117, and 118 press the soft tissue of the limb and cause soft tissue to flow or bulge between each compression member. It should be appreciated that the spaces between elongated compression members 115, 116, 117, and 118 are relief areas that receive the displaced tissue of the limb. By providing relief areas that receive displaced tissue of the limb, a user is able to tighten elongated compression members 115, 116, 117, and 118 in an amount sufficient to minimize motion without sacrificing comfort to the user. Thus, the underlying skeletal structures of the limb are captured by load carrying device 100, such that the limb and load carrying device 100 move as a single component in a more efficient manner.

Figure 3:
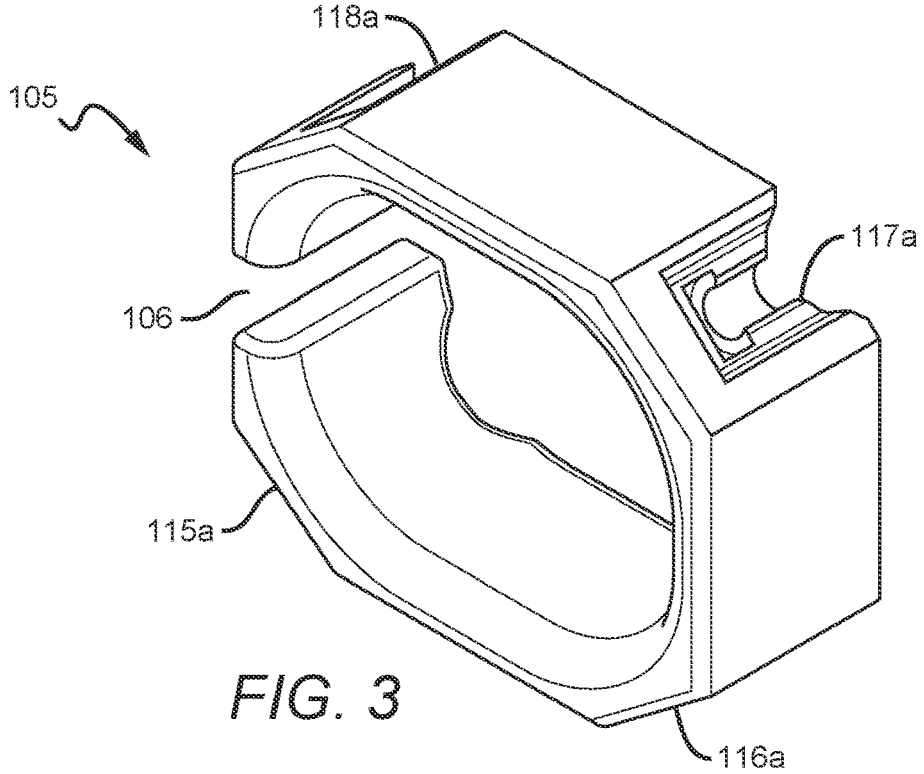
FIG. 3 is a perspective view of the distal support member of the load carrying device of FIG. 1.

FIG. 3 shows distal support member 105 separated from the other components of load carrying device 100. Support member 105 has four channels 115*a*, 116*a*, 117*a*, and 118*a*, which are configured to receive a fastener 119 for securing the distal ends of elongated compression members 115, 116, 117, and 118, thereto, respectively. Fastener 119 can comprise a screw, pin, magnet adhesive, or any other coupling suitable for removably securing the ends of an elongated compression member to a support member.

Figure 4:
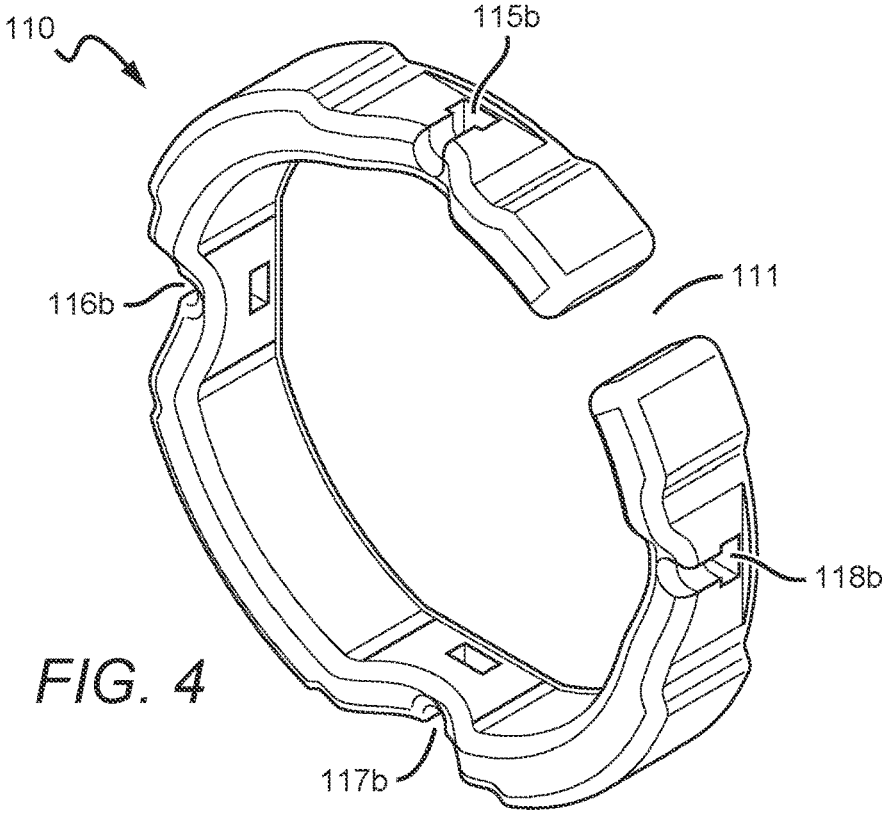
FIG. 4 is a perspective view of the proximal support member of the load carrying device of FIG. 1.

FIG. 4 shows proximal support member 110 separated from the other components of load carrying device 100. Support member 110 has four channels 115*b*, 116*b*, 117*b*, and 118*b*, which are configured to receive a fastener 119 for securing the proximal ends of elongated compression members 115, 116, 117, and 118, thereto, respectively. In alternative embodiments, one or more of the ends of the elongated compression members 115, 116, 117, and 118 can be permanently affixed to support member 105 and/or support member 110 (e.g., only one, two, or three of the elongated compression members can be detached from support members 105 and 110).

In some embodiments, support members 105 and 110 can be made of a flexible material so that they can be tightened around a limb. In yet other embodiments, support members 105 and 110 can be made of a rigid material that has moving portions that can be tightened around a limb. In addition, the elongated compression members preferably have an adjustable position to thereby adjust the pressure on soft tissue. For example, elongated compression members 115, 116, 117, and 118 can have an irregular cross sectional diameter so that rotating the elongated member about its longitudinal axis may increase or decrease pressure on the soft tissue. In yet other embodiments, fastener 119 could be of the type that allows for positional adjustment at both ends of each elongated member so that each end can be independently moved closer to, or farther from, the limb's center line (or the limb's bone). In other aspects, the support members could be one solid component or, alternatively, could be discontinuous (e.g., made of multiple components that are joined together).

Figure 5A:
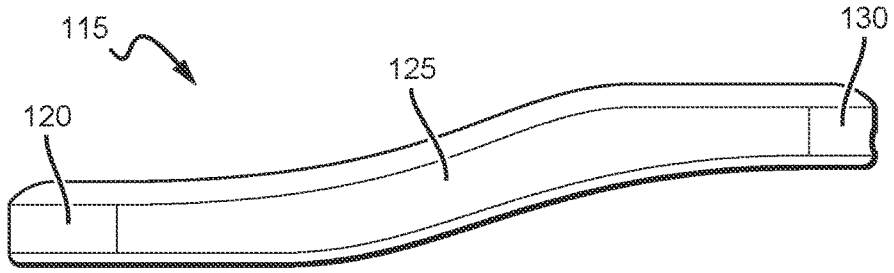
FIG. 5*a* is a side view of an elongated compression member of the load carrying device of FIG. 1.
Figure 5B:
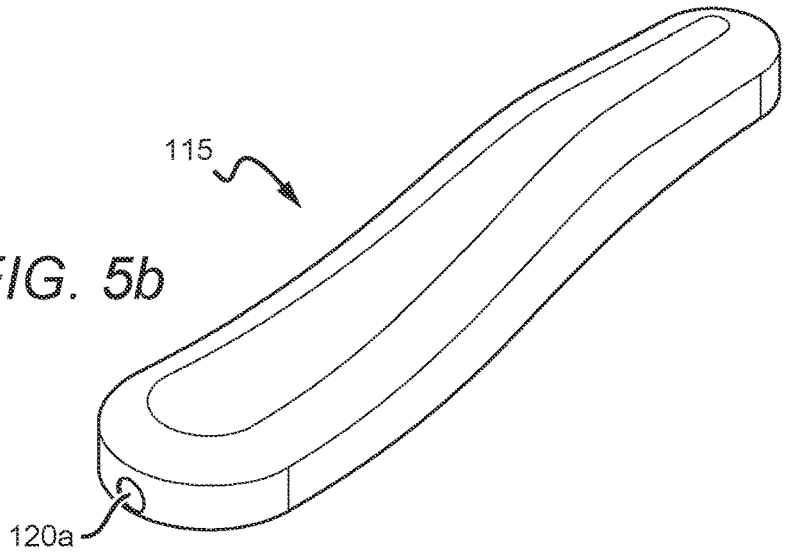
FIG. 5*b* is a perspective view of the elongated compression member of FIG. 5*a*.

FIG. 5*a* shows elongated compression member 115 separated from the other components of load carrying device 100. Elongated member 115 has a distal end 120, a middle portion 125, and a proximal end 130. Distal end 120 and proximal end 130 each have a screw or pin hole (hole 120*a* in FIG. 5*b*) for receiving fastener 119 and for removably coupling each end to support member 105 and support member 110. Middle portion 125 has an angle that is designed to match or otherwise accommodate the contours of the limb.

Figure 6A:
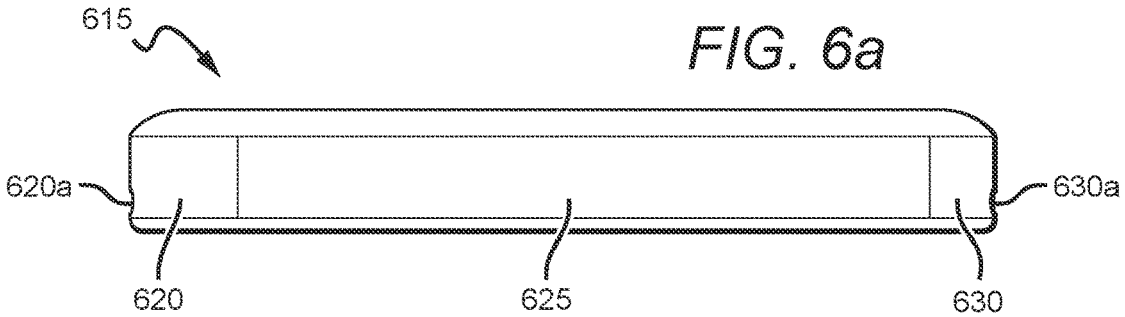
FIG. 6*a* is a side view of another embodiment of an elongated compression member.
Figure 6B:
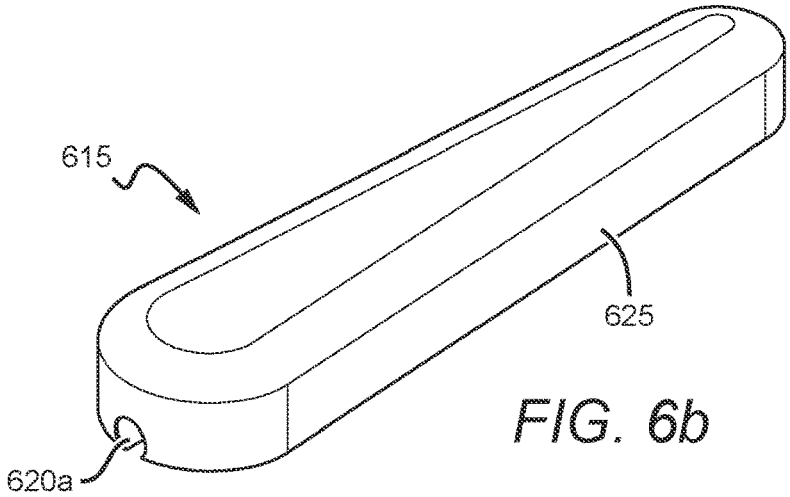
FIG. 6*b* is a perspective view of the elongated compression member of FIG. 6*a*.

FIG. 6*a* shows an alternative elongated compression member 615. Elongated compression member 615 has a distal end 620, a middle portion 625, and a proximal end 630. Distal end 620 and proximal end 630 each have a screw or pin hole (hole 620*a* in FIG. 6*b*) for receiving fastener 119 and for removably coupling each end to support member 105 and support member 110. Middle portion 625 is straight, unlike the angle of elongated member 115. It is contemplated that elongated compression member 615 can be interchangeable with elongated member 115 (e.g., both elongated members can removably couple with support members 105 and 110).

The elongated compression members are alternatively referred to herein as struts. It is contemplated that the struts can be made of one unitary material, such as a metal alloy, a polymer. Alternatively, the struts can be made of different materials, or layers of materials, to provide a range of desirable properties. Contemplated manufacturing methods include casting, molding, forming (e.g., thermoforming, 3D printing, forging, rolling, extruding, pressing, bending, shearing, piercing, stamping), machining (e.g., milling, turning, drilling, routing, laser cutting, grinding, finishing, etc.), joining (e.g., welding, adhesive bonding, fastening, press fitting, etc.).

The struts can be made in standard sizes that a user selects using a fitting chart. In addition, it is contemplated that the struts can be custom manufactured to a specific size and shape by measuring or scanning the limb, and then fitting all struts (and/or the support members) of the device 100 to the limb in a manner that optimizes comfort and minimizes lost motion between the device and the limb. It is also contemplated that alternative embodiments of elongated members can have adjustable lengths to provide additional customization. In yet other aspects, an unassembled load carrying device can be sold in a kit that contains struts of different sizes to fit different limb sizes. The components preferably have quick-connect fasteners for ease of assembly. In addition, the kit could also include cutting, shaping, forming, and/or joining tools that allow the user to cut a strut to the desired size to create a custom load carrying device.

The struts of device 100 are spaced apart in equal increments (e.g., every 90 degrees). However, it is contemplated that the struts can be spaced apart in unequal increments. In some embodiments, the radial position of the struts can be adjusted or repositioned at different radial locations around the limb to provide better customization. It is further contemplated that device 100 could comprise less than, or more than, the four struts shown. It should be appreciated that the spaces between the struts define relief areas. The relief areas allow a user to tighten device 100 in an amount sufficient to increase the density of the soft tissue underlying the struts. In this manner, device 100 creates alternating areas of high density and low density soft tissue such that motion between device 100 and the skeletal structure of the limb is significantly minimized compared to a cuff, strap, sleeve, or other device that applies more uniform pressure.

In other words, the compression members apply enough pressure such that the density of underlying soft tissue is significantly increased. In this manner, the order to impart motion onto device 100 sufficiently increased to thereby reduce the movement of the device relative to the skeletal structure.

In this manner, device 100 is secured to the limb d is preferably minimized by 50%, more preferably at least 80%, most preferably at least 90%.

While the struts contemplated herein have an elongated dimension, (e.g., a longitudinal axis), it is contemplated that device 100 could comprise compression zones that are not longitudinal. For example, the compression members could apply a circular or square compression zone to the limb to lock the bone at a specific location.

Figure 7:
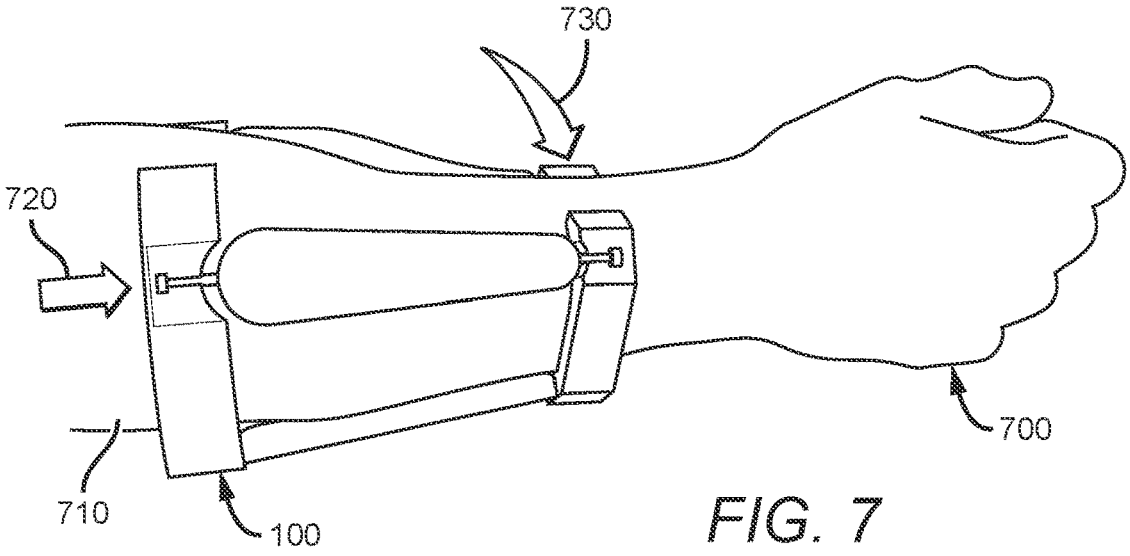
FIG. 7 is a perspective view of the load carrying device of FIG. 1. on a user's arm.

FIG. 7 shows a user 700 placing load carrying device 100 on the user's right arm 710. The method of placing or donning device 100 can include the steps of: (i) sliding a distal portion of the user's limb (e.g., hands, wrists) through the inner diameter of proximal support member 110 in direction 720, and then inserting the limb (e.g., forearm) down through opening 106 of distal support member 105 in direction 730. Alternatively, the method of placing device 100 can comprise the steps of (i) inserting a portion of the limb through opening 106 of distal support member 105 in direction 730; and (ii) inserting a portion of the limb through opening 110 of proximal support member 110. In yet other embodiments, the method of donning device 100 could include the step of placing the limb above, in front of, to the side of, or in back of, the opening of the support member, and then inserting the limb into the support member through the opening. When the support member comprises a solid closed loop (e.g., a ring structure), then the method of donning the device can comprise the step of inserting the limb through the inner diameter of the support members. It is also contemplated that the support members and/or elongated members can expand outward to receive a limb that has a larger outer diameter than the inner diameter of the support members. Expandable support members and expandable elongated members can also be coupled with a control system (e.g., sensors, actuators, processor, software executable instructions) configured to automatically adjust the expansion of the device.

Figure 8A:
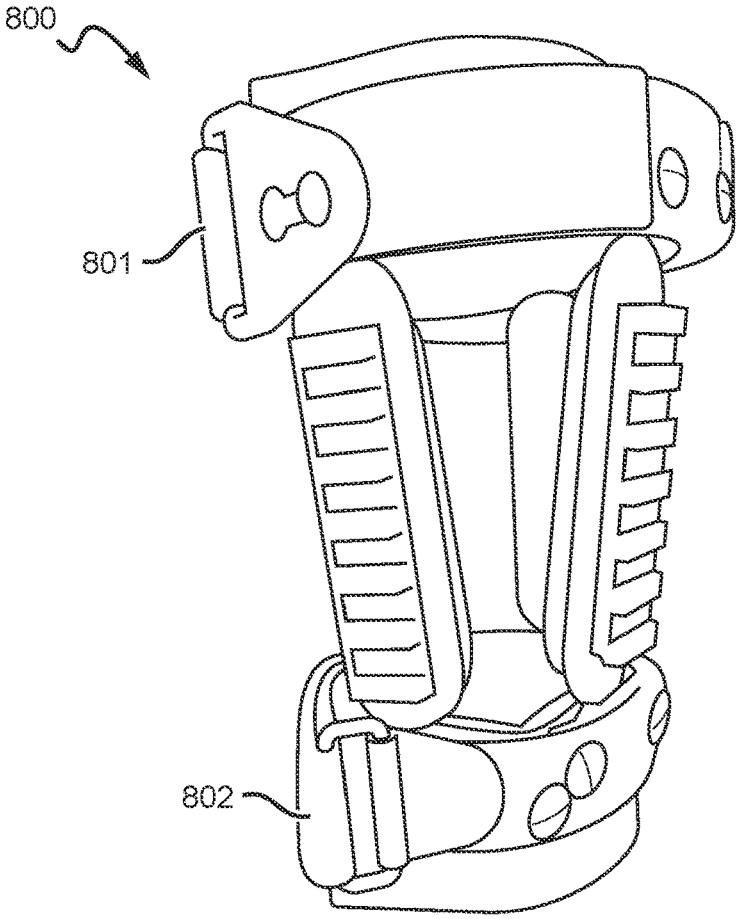
FIG. 8*a* is a side view of another embodiment of a load carrying device to be worn on a user's lower arm.

FIG. 8*a* shows a load carrying device 800 to be worn on a user's lower arm. Device 800 has a first support member and a second support member (e.g., distal and proximal), and four elongated compression members, like device 100. However, the components of device 800 are made of a composite design that includes a hard plastic layer for rigidity and a foam layer for cushion and comfort. The distal and proximal support members have a hook and loop fastener strap 801 and 802, respectively, for loosening and tightening the support members on the user's lower arm.

Figure 8B:
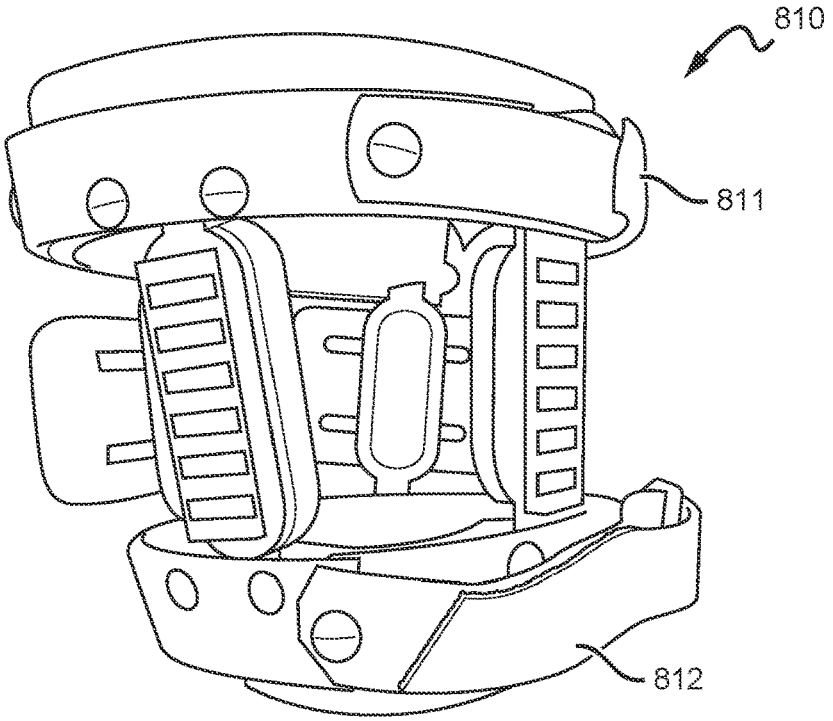
FIG. 8*b* is a side view of another embodiment of a load carrying device to be worn on a user's upper arm.

FIG. 8*b* shows a load carrying device 810 to be worn on a user's upper arm, either in combination with device 800 or alone. The composite construction of device 810 is similar to device 800, and includes hook and loop straps 811 and 812 for tightening the proximal and distal support members, respectively. However, the inner diameters of the support members and the length and shape of the elongated compression members of device 810 are sized and dimensioned to accommodate the contours of the upper arm, whereas device 800 is sized and dimensioned to accommodate the contours of the lower arm.

Figure 8C:
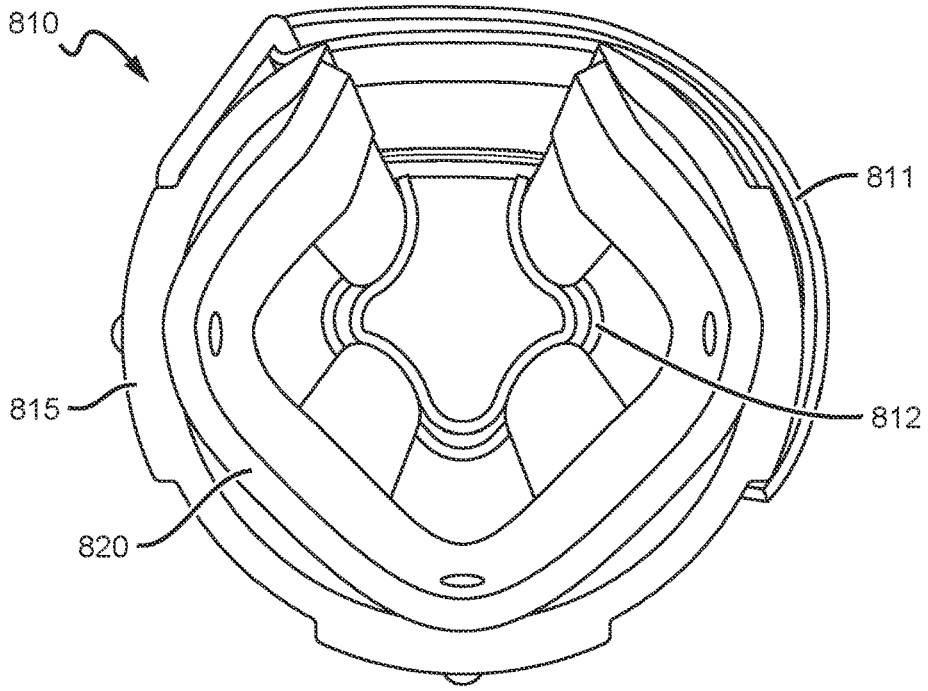
FIG. 8*c* is a top view of the load carrying device of FIG. 8*b*.

FIG. 8*c* shows a top view of load carrying device 810. From this perspective, the different layers of the device are clearly shown, including the rigid hard plastic layer 815 and soft foam padding layer 820.

FIG. 8*d* shows load carrying device 810 with a load 830 removably attached thereto. Load 830 is depicted as a weight that can be used for endurance training. However, it is contemplated that load 830 could be any item that the user desires to carry and/or use. For example, load 830 could comprise a cell phone, GPS device, a weapon, equipment, a piece of armor (e.g., an armor plate), a field viewing instrument (e.g., IR viewer for nighttime operation), laser range finder, crowd dispersal means, a medical kit, and so forth. In another example, the user can be a soldier and load 830 could be treatment devices. These different loads may be interchangeably attached to specific points or fixtures on the load carrying device.

Load 830 removably attaches to device 810 via a quick release lever fastener 835. FIG. 8*e* shows the quick release lever fastener apart from device 810. Those of ordinary skill in the art will appreciate that many other types of removable couplings can be used to attach load 830 to device 800, including, mechanical fasteners (e.g., threads and screws, male-female fasteners, clips, hook and loop fasteners), magnets, and adhesives, to name a few.

Load 830 attaches to device 810 at a first attachment point. The attachment point can be on a support member, an elongated compression member, or a combination thereof. Device 810 has multiple quick release lever fasteners to provide several attachment points at different locations.

It some applications, the attachment point is used to attach device 810 to another load carrying device, or to a load distribution system such as an exoskeleton suit. As used herein, "exoskeleton suit" means a wearable rigid or semi-rigid frame that provides support for carrying and distributing the weight of a load. Exoskeleton suits can be powered or non-powered. In some embodiments, the load carrying device itself can be an exoskeleton suit on its own. Alternatively, the load carrying device can make up part of an exoskeleton suit when used in combination with other load carrying devices and/or load carrying equipment. Exoskeleton suits that incorporate the inventive subject matter described herein will amplify, augment, and/or reinforce the user's natural abilities with minimal reduction to mobility.

FIG. 9 shows an end of a strut and a bracket. The end of the strut has two flexible prongs with tapered ends that fit inside the bracket. When fully inserted, the prongs expand outward around the bracket and catch on the edge of the bracket to prevent removal. The prongs and then be pinched together to remove the end of the strut from the bracket. In this matter, the strut can be quickly removed from a support member and can then be replaced with a different size or shape strut.

Figure 10A:
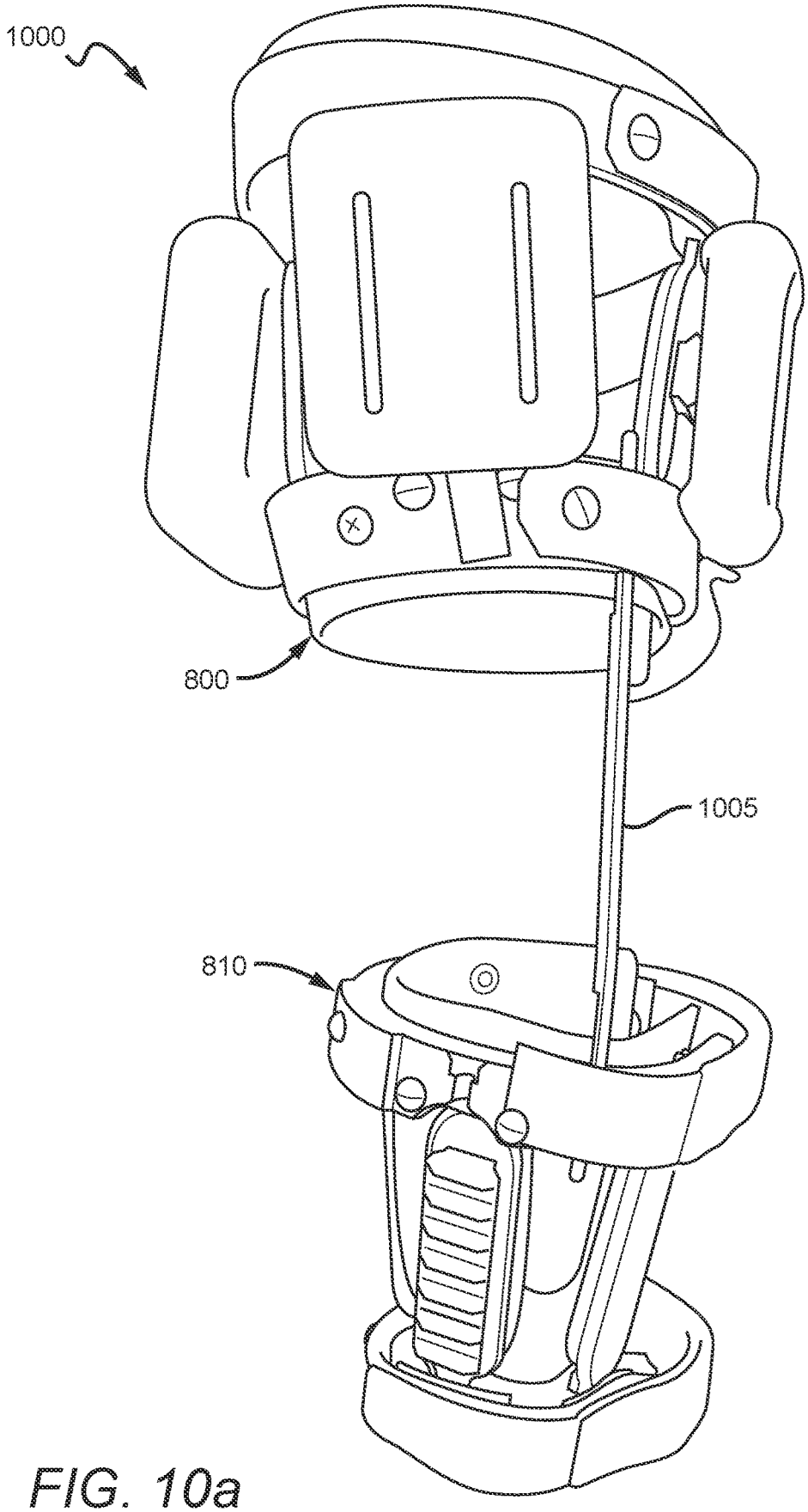
FIG. 10*a* is a side view of a load distribution system comprising two load carrying devices coupled together via a flexible joint.
Figure 10B:
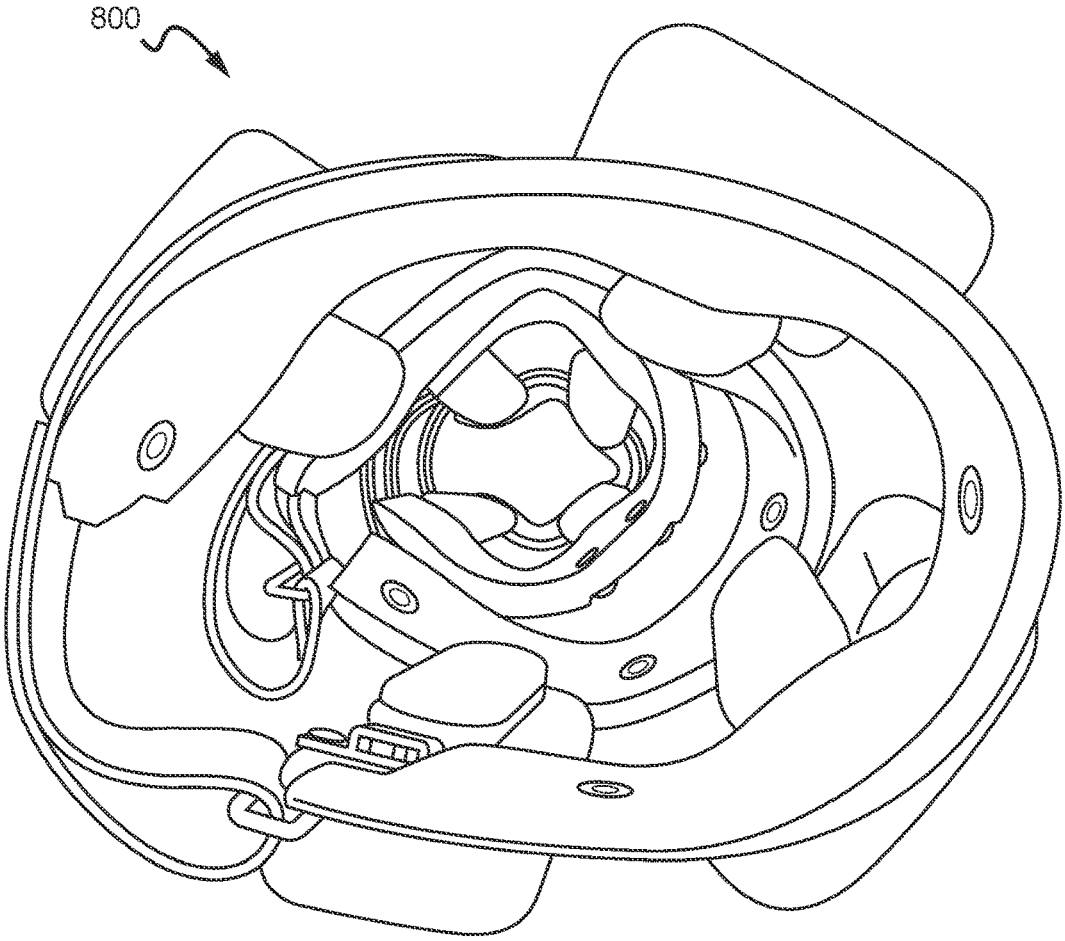
FIG. 10*b* is a top view of the system of FIG. 10*a*.
Figure 10C:
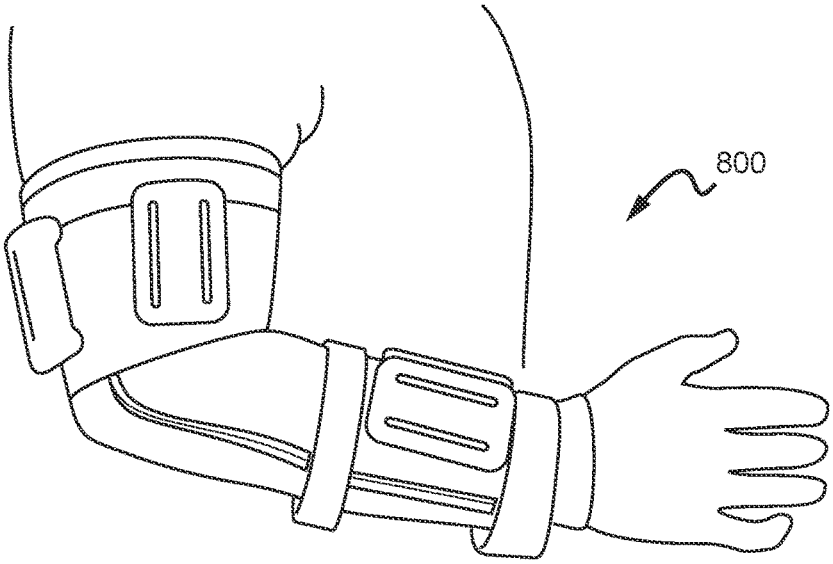
FIG. 10*c* is a side view of the user of FIG. 10*a* with the right hand and on over a liner held in a right angle position.

FIG. 10*a* shows a side view of a load distribution system 1000, which comprises device 800 and device 810 connected via a flexible joint 1005. FIG. 10*b* shows a top view of device 800 and device 810. Flexible joint 1005 helps distribute weight of the load between device 800 and 810, and also helps to maintain the position of devices 800 and 810. Flexible joint 1005 also allows the user to transition between a straight arm orientation (e.g., arm at a similar angle as that shown in FIG. 22 below), and a bent arm orientation, as shown in FIG. 10*c*. It should also be noted that the user in FIGS. 10*c* and 10*d* is wearing a liner between the soft tissue and the load carrying devices. The liner has sufficient elasticity to allow the soft tissue to bulge between compression members with minimal restriction. In addition, it is further contemplated that the liner can include hook and loop fasteners or other types of fasteners and/or features that attach to the load carrying devices to maintain correct positioning and provide additional comfort.

In yet other alternative embodiments, it is further contemplated that the load carrying device can be worn over an article of clothing. The article of clothing (e.g., shirt, jacket, pants, socks, etc.) can be manufactured with relief zones that allow the soft tissue to bulge and flow between struts. The article of clothing could also include attachment points and fasteners for attaching the load carrying device to the article of clothing. In yet other embodiments, the load carrying device can be worn under an article of clothing, and either completely or partially concealed. In such embodiments, the articles of clothes can have openings, slits, or other access features that allow the user to attach an external load to an attachment point on the load carrying device that is underneath clothing. It is contemplated that the article of clothing can have cushion to provide additional comfort to the user. Furthermore, the article of clothing can have portions with thicker materials where compression is anticipated and thinner, elastic materials in relief areas.

Figure 11:
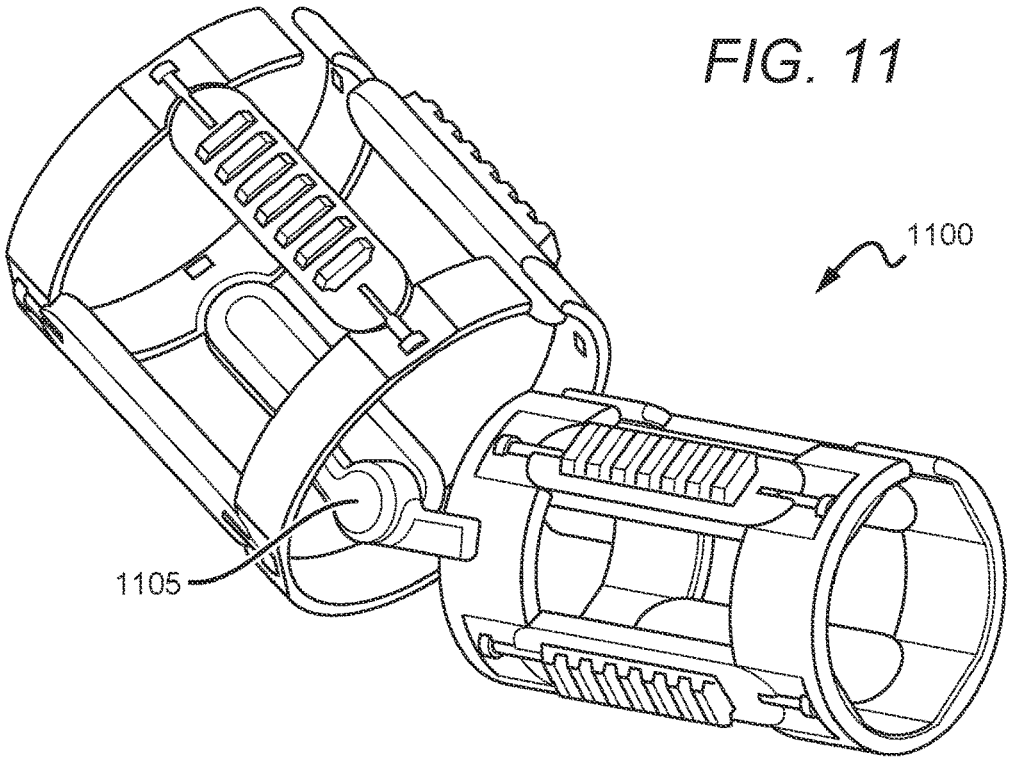
FIG. 11 is a perspective view of yet another embodiment of a load distribution system comprising an upper limb load carrying device and a lower limb load carrying device joined by a connector.

FIG. 11 shows another load distribution system 1100 for radial and humeral applications. System 1100 is similar to system 1000 in many aspects. One difference is that the elongated members (e.g., compression paddles) attach to the support members snap into the support members via pins that are sized and dimensioned to press fit into grooves in the support member and/or elongated member. System 1100 also has a rigid hingeably coupling 1105 as opposed to a flexible joint 1005.

Figure 12:
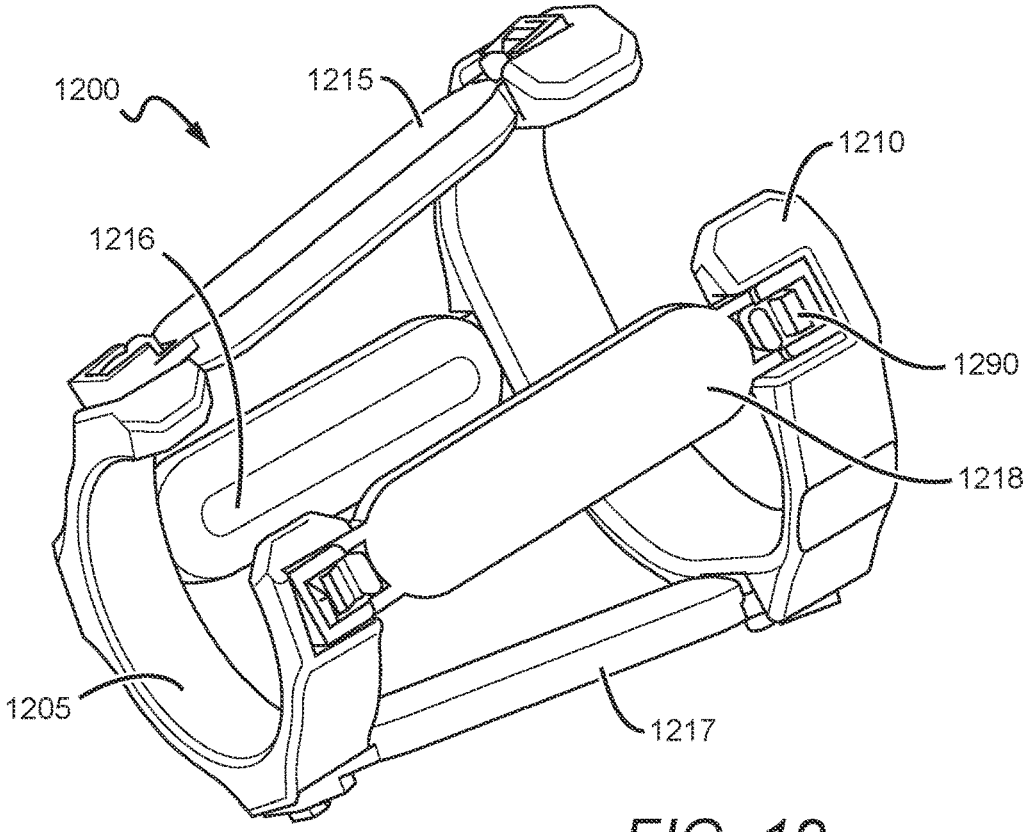
FIG. 12 is a perspective view of yet another embodiment of a load carrying device.
Figure 13:
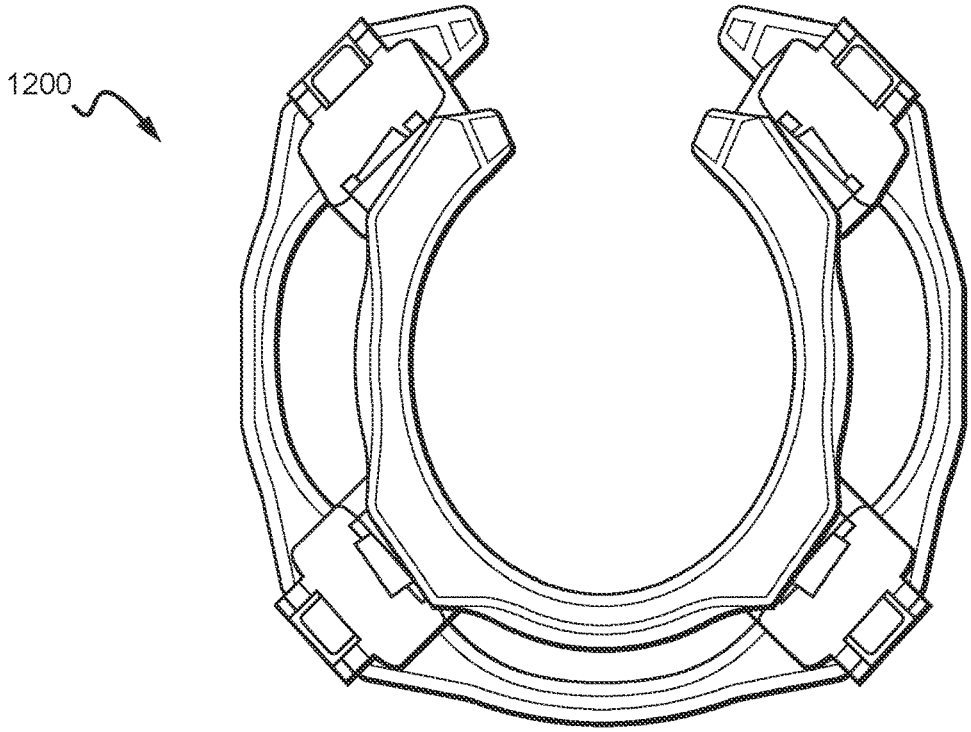
FIG. 13 is a front view of the load carrying device of FIG. 12.

FIG. 12 shows a load carrying device 1200 comprising a distal cuff 1205 and a proximal cuff 1210 connected by elongated compression members 12. FIG. 13 shows a front view of load carrying device 1200. Load carrying device 1200 is different than load carrying device 100 in that elongated compression members 1215, 1216, 1217, and 1218 removably couple with cuffs 1205 and 1210 via a ratchet engagement.

Figure 14:
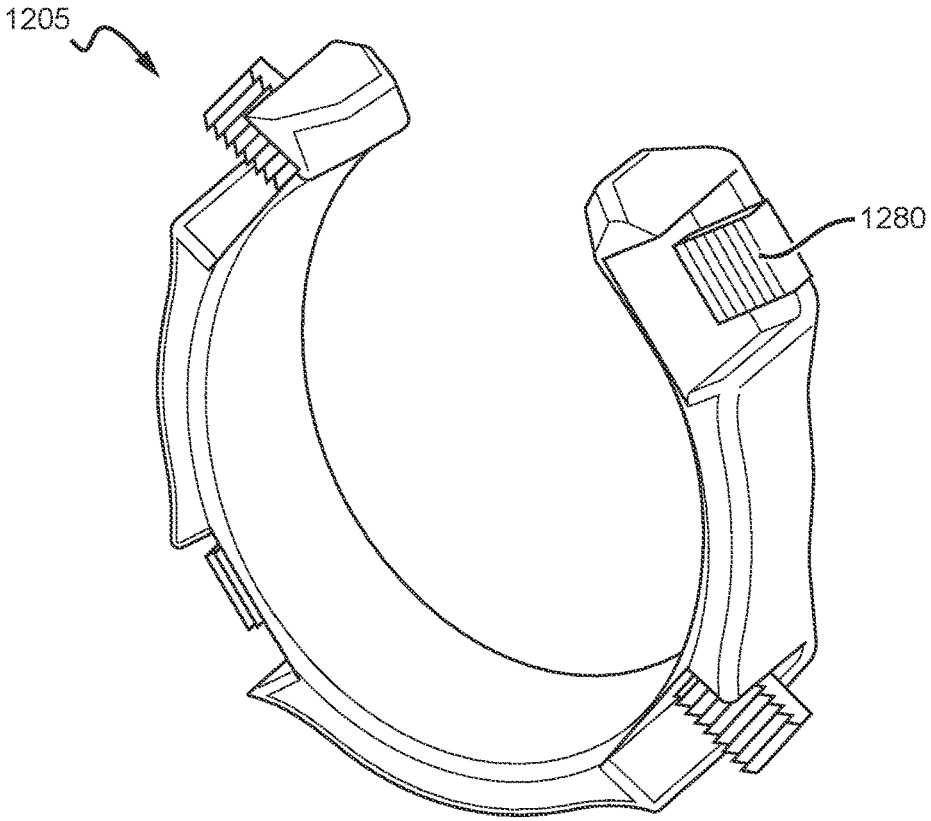
FIG. 14 is a perspective view of the distal cuff of the load carrying device of FIG. 12.
Figure 15:
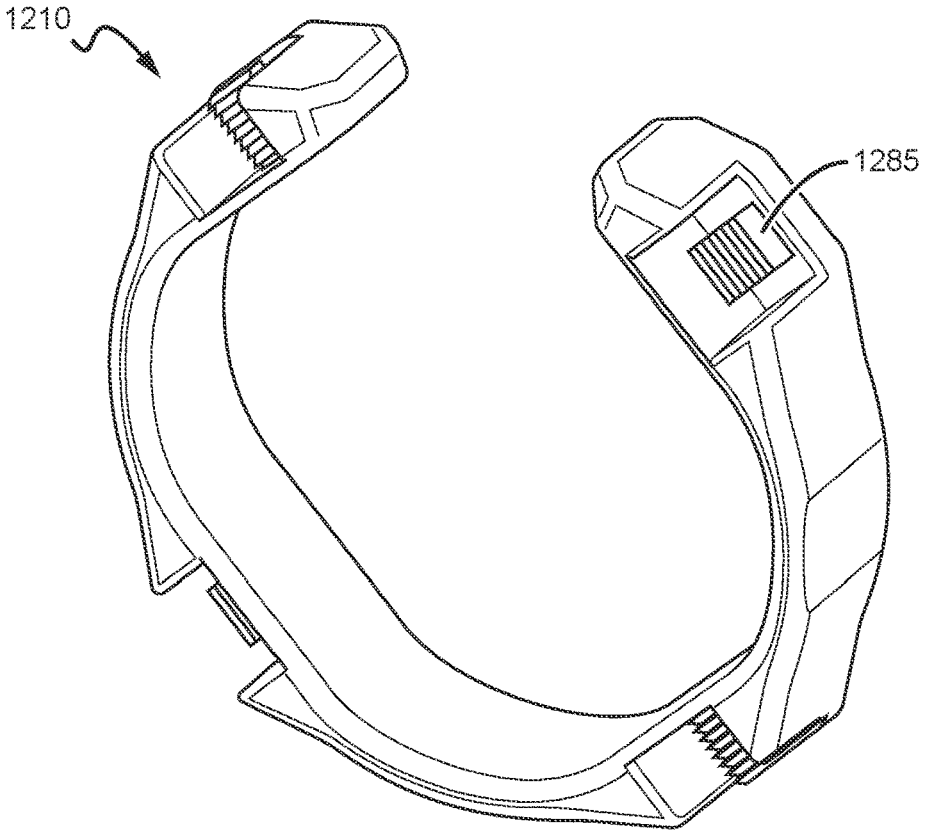
FIG. 15 is a perspective view of the proximal cuff of the load carrying device of FIG. 12.
Figure 16:
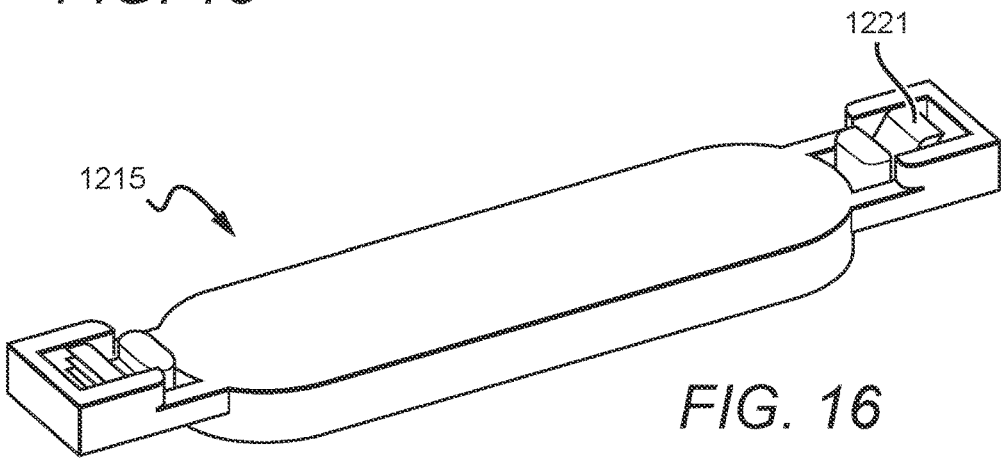
FIG. 16 is a perspective view of an elongated compression member of the load carrying device of FIG. 12.
Figure 17:
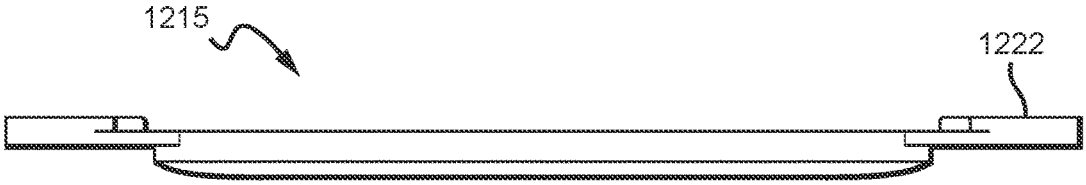
FIG. 17 is a side view of an elongated compression member of the load carrying device of FIG. 12.

FIG. 14 and FIG. 15 show toothed portions 1280 and 1285 on cuffs 1205 and 1210, respectively. The toothed portions 1280 and 1285 are sized and dimensioned to engage toothed portions on an elongated compression member. FIGS. 16 and 17 show elongated compression member 1215 having a toothed portion 1221 and 1222. Other mechanical engagements are contemplated, including a pin/screw and slot, and a double prong and bracket. One benefit of these mechanical engagements is they only require a very low profile of space beyond the skin. FIG. 17 shows the profile of the elongated compression member 1215, with the main body being linear along its longitudinal axis and symmetrical about both the longitudinal and perpendicular axis. The side of the elongated compression member in contact with the skin is rounded along the edges for both comfort and to allow proper compression and release of soft tissue.

Figure 18:
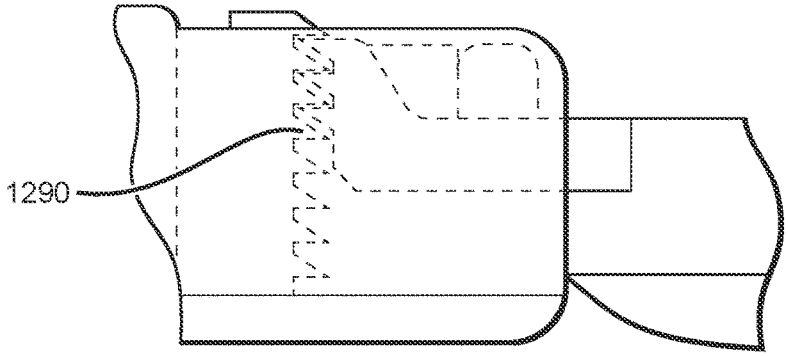
FIG. 18 is a close-up side view of the ratchet engagement of the load carrying device of FIG. 12.
Figure 19:
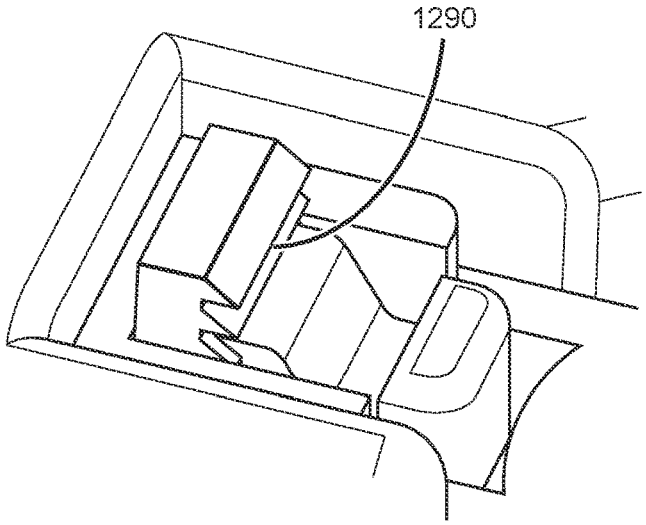
FIG. 19 is a top perspective view of the ratchet engagement of the load carrying device of FIG. 12.

FIG. 18 shows a side view of the ratchet engagement of load carrying device 1200 and FIG. 19 shows a top perspective view of the ratchet engagement. The ratchet engagement allows elongated compression members to removably couple with cuffs 1205 and 1210. The ratchet engagement also allows for adjustment and repositioning of the elongated compression members relative to the user's bone. This allows for adjustment of the degree/level of compression and can be used to fit device 1200 to a user's limb. It also allows for the angle of the elongated compression members to be adjusted (by independently adjusting each end of the compression member).

Figure 20:
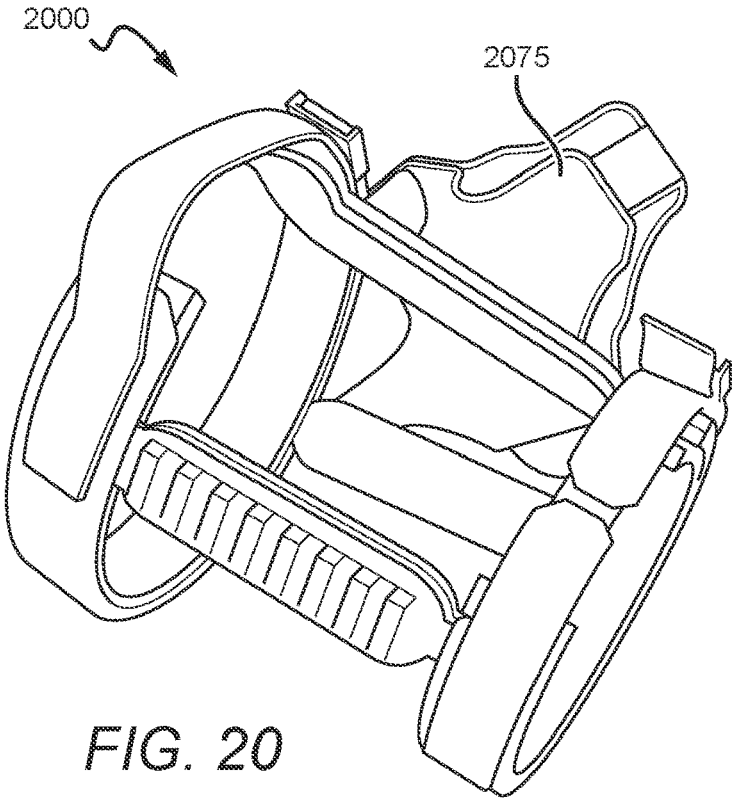
FIG. 20 is a perspective view of another embodiment of a load carrying device having a gun holster attached thereto.

FIG. 20 shows a load carrying device 2000 that has a gun holster 2075 attached thereto for holding a gun. Holster 2075 can couple to an elongated compression member or a cuff of device 2000 via any fastener suitable for securing holster 2075 in place. For example, the elongated compression member or cuff may have various attachment mechanisms such as a picatinny rail, through slot, hook and loop, or angled surface for mounting any conceivable device or tool of reasonable size and weight.

Load carrying device 2000 also has straps to close the support cuff openings for ease of donning. The strap consists of a first end, which is fixed to the cuff at one side of the opening, and a second end, which is removably coupled with the opposing side of the opening. This coupling can comprise any adjustable-length connector for providing tension to reduce the size of the opening, including straps with buckles. The strap may also be adjustable through means including but not limited to a strap adjuster or tension lock. The strap may also consist of a small section of elastic material, to allow for a pre-determined amount of expansion of the cuff during flexion or other instances of an increase in cross-sectional area of the limb at the location where the cuff resides.

FIG. 21 shows a load distribution system 2100 in a bent configuration and FIG. 22 shows system 2100 in a straight configuration. System 2100 comprises a first limb load carrying device 2120 and a second limb carrying device 2140 that work together. It is contemplated that first limb carrying device 2120 and second limb carrying device 2140 can be disposed on either the upper limb or lower limb. The first and second load carrying devices 2120 and 2140 are coupled by a rigid and hinging elbow connector 2060. Connector 2060 functionally couples the first and second load carrying devices 2120 and 2140 to help distribute weight and provide better stabilization.

FIG. 23 shows a load carrying device 2300 worn by a user in combination with an elbow strap 2330. Strap 2330 goes around the user's elbow to help secure device 2300 in place when carrying load 2320. It is contemplated that strap 2330 has a quick release mechanism. Strap 2330 can be modified to provide tension and the tension could be adjustable by the user.

FIG. 24 shows an embodiment of a load carrying device 2400 for a dynamic strap that comprises a first end which is attached to the end of a flat spiral spring or constant force spring 2430 inside a protective case that is attached to or integrated into the lateral side of the proximal support cuff. Constant force spring 2430 is wound around a spool 2410. Spool 2410 rotates freely around the center post of the circular box, so that constant force spring 2430, which is fixed to spool 2410, may be unwound and rewound as necessary. The dynamic strap is drawn across the cubital fold anterior to the arm, turning back posteriorly above the epicondyle, and back anteriorly across the cubital fold to the second end, which is attached in a static manner to the medial side of the proximal support cuff. This arrangement allows for the elbow strap to maintain set tension around the forearm and epicondyle as the arm is flexed and extended. Additionally, it should be noted that the second end may be designed to be adjusted initially to the user, through perhaps a prong and hole, or another alternative.

In an alternative embodiment is a static elbow strap comprising a first end coupled to a point on the lateral side of the proximal support cuff. The strap is drawn across the cubital fold anterior to the arm, turning back posteriorly above the epicondyle, and back anteriorly across the cubital fold to the second end, which is coupled to the medial side of the proximal support cuff. These couplings at the first and second end of the static elbow strap may conceivably be either measured for a particular user and fixed, or consist of a manual adjustment method such as a strap adjuster or tension lock.

In either of these strap embodiments the second end of the strap could either be fixed permanently to the proximal cuff, or preferably, removably, to increase ease of donning.

The inventive subject matter includes methods of fitting a load carrying device to a user. For example, the cuffs can be positioned at 1.5 inches from the styloid and at 3 inches from the cubital fold. The distance between the styloid and cubital fold is used to determine the approximate length of the compression members. Alternatively, the cuffs can be attached at a location that will not interfere with either the motion of the wrist or flexion of the elbow. It is contemplated that cuffs can be custom manufactured to a specific size and shape by measuring, scanning, or casting the arm.

The inventive subject matter also includes load carrying devices that comprise only one cuff that has an inside surface comprising alternative compression and relief zones configured to compress the soft tissue and stabilize the bone. The width of the cuff and the size of the compression and relief zones can be selected based on the weight of the expected loads. For example, if the load carrying device is used to carry a light load, such as a mobile electronic device, then the compression and relief zones may be relatively small. In such applications, the load carrying device preferably has a quick release attachment point with a hinging and/or rotating joint to adjust the position of the electronic device for better visibility and usability. In the warfighter application, the electronic device could be configured to monitor the weight of your load.

In yet other aspects of alternative embodiments, the load carrying devices described herein can further include actuators, sensors, and control systems for automating load distribution. For example, the load carrying devices can be programmed to self-adjust based on the user's movements and/or external conditions (e.g., weather, etc.).

The single cuff embodiments can optionally connect to a second cuff via an elongated compression member or a rigid frame structure to increase the load capacity.

The load distribution systems contemplated herein preferably comprise modular components that may be interchangeable for rapid replacement. The system may be provided as a kit which includes sets of struts, each provided with mounting locations and associated fixtures, adjustable straps or rigid custom designed cuffs that can be connected to the struts to form distal and proximal cuffs, attachment points for the ends of the struts, and additional mountable fixtures designed to hold selected implements where and as needed for given application. Different components comprising a particular LDS may be off-the-shelf or custom designed via a priori measurements and/or scanning. The struts, which are made of rigid material, which can be a composite such as carbon composites, plastics and other rigid materials known in the art of prosthetic sockets, are prefabricated using a variety of techniques including, but not limited to, 3D printing for maximal cost effectiveness.

The struts exert the compression zones longitudinally, while allowing tissue to bulge outward, thereby creating the osseostabilization system, which captures the bone but does not cause discomfort to the user. This alternating compression and release technology provides a platform for safe and efficient mounting of loads to various locations on the operator's extremities. In various embodiments of the LDS, the specific compression levels can be constant, having been adjusted and customized a priori to the individual, or they can include dynamic adjustment means which can be mechanical, electromechanical, chemical, or any other suitable means. In the dynamic LDS embodiments, the adjustments may be performed manually by the user, or they can be automatic, responding to data input from embedded sensors that measure local pressure levels as a function of time.

The LDS can bring osseostabilization technology to Tactical Assault Light Operator Suit TALOS, allowing a more biomechanically efficient man-machine interface, increasing system performance and operator efficiency in the field. Improvements in the human interface would also enable superior performance from the warrior web, and may even allow revisiting of heavier suits such as HULC and XOS 2, as well as other 'smart" enhanced human/technology interfaces. By placing the task of connectivity on the neuromusculoskeletal system as a unified whole, rather than on simple soft tissue weight bearing, the human operator and any attached devices become a biomechanically integrated unit. The inventor believes that by viewing the human musculoskeletal system with externally attached devices/payloads as a unified and integrated system, it will be possible to eliminate bulky and cumbersome interface elements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Thus, specific compositions and methods of load distribution systems have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A load carrying and force distributing interface to be worn on a user's limb having soft tissue and a bone structure, comprising:

a first support member sized and dimensioned to fit around the limb;

a second support member sized and dimensioned to fit around the limb;

at least three elongated compression members disposed between the first support member and the second support member;

wherein the elongated compression members are circumferentially spaced apart; and a sensor, an actuator, and a controller configured to dynamically adjust a compression level of at least one of the elongated compression members.

2. The interface of claim 1, wherein the controller is configured to adjust a compression level of at least one of the elongated compression members by adjusting a distance of at least one of the elongated compression members from a center axis of the first support member and the second support member.

3. The interface of claim 1, wherein the controller is configured to adjust a compression level of at least one of the elongated compression members by rotating at least one of the elongated compression members about its longitudinal axes.

4. The interface of claim 1, wherein the controller is configured to adjust a compression level of at least one of the elongated compression members based on the user's movements.

5. The interface of claim 1, wherein the controller is configured to adjust a compression level of at least one of the elongated compression members based on an external condition.

6. The interface of claim 5, wherein the external condition is weather.

7. The interface of claim 1, wherein the controller is configured to adjust a compression level of at least one of the elongated compression members based on data input from the sensor.

8. The interface of claim 7, wherein the data input is pressure.

9. The interface of claim 1, wherein at least one of the elongated compression members is expandable.

10. The interface of claim 9, wherein the controller is configured to automatically adjust expansion of at least one of the elongated compression members.

11. The interface of claim 1, wherein at least one of the elongated compression members are permanently attached to the first support member and the second support member.

12. The interface of claim 1, wherein at least one of the elongated compression members are removably coupled with the first support member and the second support member.

13. The interface of claim 1, wherein at least one of the elongated compression members are circumferentially spaced apart in equal increments.

14. The interface of claim 1, wherein the elongated compression members are circumferentially spaced apart in unequal increments.

15. The interface of claim 1, wherein a radial position of at least one of the elongated compression members is adjustable.

16. The interface of claim 1, wherein the controller is configured to dynamically adjust a compression level of at least one of the elongated compression members so as to reduce movement of the interface relative to the bone structure when worn on the user's limb.

17. A method of using a load carrying and force distributing interface on a limb of the person, the load carrying and force distributing interface comprising:

a first support member and a second support member that are sized and dimensioned to fit around the limb;

at least three elongated compression members disposed between the first support member and the second support member, wherein the elongated compression members are circumferentially spaced apart; and a sensor, an actuator, and a controller configured to dynamically adjust a compression level of at least one of the elongated compression members;

the method comprising the steps of:

placing or donning the load carrying and force distributing interface on the limb; and adjusting a compression level of at least one of the elongated compression members so as to reduce motion of the interface relative to a bone structure of the limb.

18. The method of claim 17, wherein the step of placing or donning the interface comprises sliding the limb through an inner diameter of the first support member and the second support member.

19. The method of claim 17, wherein the step of placing or donning the interface comprises inserting the limb through a side opening of the first support member and the second support member.

20. The method of claim 17, wherein the load carrying and force distributing interface further comprises a sensor, an actuator, and a controller configured to dynamically adjust the compression level of at least one of the elongated compression members.

21. The method of claim 20, wherein at least one of the first support member and the second support member are expandable.

22. The method of claim 21, wherein the controller and actuator are configured to adjust expansion of at least one of the first support member and the second support member.

23. A load carrying and force distributing interface to be worn on a user's limb having soft tissue and a bone structure, comprising:

a first support member;

a plurality of elongated compression members including a first elongated compression member, a second elongated compression member, and a third elongated compression member;

wherein each of the first, second, and third elongated compression members couples with the first support member at locations that are circumferentially spaced around the user's limb; and a sensor, actuator, and controller configured to adjust a compression level of at least one of the elongated compression members to compress the soft tissue against the bone structure to thereby reduce motion of the bone structure towards a wall of the load carrying and force distributing interface.

* * * * *